US008741528B2

(12) United States Patent
Anno et al.

(10) Patent No.: US 8,741,528 B2
(45) Date of Patent: Jun. 3, 2014

(54) ELECTROSTATIC CHARGE IMAGE DEVELOPING TONER, ELECTROSTATIC CHARGE IMAGE DEVELOPER, TONER CARTRIDGE, DEVELOPER CARTRIDGE, PROCESS CARTRIDGE, IMAGE FORMING APPARATUS, AND IMAGE FORMING METHOD

(75) Inventors: Shintaro Anno, Kanagawa (JP); Yoshifumi Iida, Kanagawa (JP); Eiji Kawakami, Kanagawa (JP); Masahiro Takagi, Kanagawa (JP)

(73) Assignee: Fuji Xerox Co., Ltd., Toyko (JP)

( * ) Notice: Subject to any disclaimer, the term of this patent is extended or adjusted under 35 U.S.C. 154(b) by 34 days.

(21) Appl. No.: 13/566,608

(22) Filed: Aug. 3, 2012

(65) Prior Publication Data

US 2013/0252165 A1 Sep. 26, 2013

(30) Foreign Application Priority Data

Mar. 23, 2012 (JP) ..... 2012-067652

(51) Int. Cl.
*G03G 13/08* (2006.01)

(52) U.S. Cl.
USPC ..... 430/123.51; 430/108.7; 430/108.8; 430/123.41; 430/125.3

(58) Field of Classification Search
USPC ..... 430/108.7, 108.8, 123.51, 123.41, 430/125.3; 399/111, 262
See application file for complete search history.

(56) References Cited

U.S. PATENT DOCUMENTS

| | | | | |
|---|---|---|---|---|
| 5,695,902 | A | 12/1997 | Mikuriya et al. | |
| 6,403,686 | B1 * | 6/2002 | Pickett et al. | 524/310 |
| 7,536,140 | B2 * | 5/2009 | Andoh et al. | 399/276 |
| 2010/0143001 | A1 * | 6/2010 | Chuang et al. | 399/262 |

FOREIGN PATENT DOCUMENTS

| | | |
|---|---|---|
| JP | A-9-204065 | 8/1997 |
| JP | A-2009-25748 | 2/2009 |
| JP | A-2009-120416 | 6/2009 |
| JP | A-2010-2873 | 1/2010 |
| JP | A-2010-39005 | 2/2010 |
| JP | A-2010-160367 | 7/2010 |

* cited by examiner

*Primary Examiner* — Thorl Chea
(74) *Attorney, Agent, or Firm* — Oliff PLC

(57) ABSTRACT

An electrostatic charge image developing toner including toner particles containing a colorant, a binder resin and a release agent; and an external additive, in which the external additive contains inorganic particles having hydrocarbon oil that contains a saturated hydrocarbon having a ring structure on the surfaces thereof.

13 Claims, No Drawings

ELECTROSTATIC CHARGE IMAGE DEVELOPING TONER, ELECTROSTATIC CHARGE IMAGE DEVELOPER, TONER CARTRIDGE, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-067652 filed Mar. 23, 2012.

BACKGROUND

1. Technical Field

The present invention relates to an electrostatic charge image developing toner, an electrostatic charge image developer, a toner cartridge, a developer cartridge, a process cartridge, an image forming apparatus, and an image forming method.

2. Related Art

A method of visualizing image information through an electrostatic charge image, such as electrophotography, is now being used in a variety of fields. In electrophotography, an electrostatic charge image (electrostatic latent image) is formed on a photoreceptor (image holding member) through charging and exposing, developed using a developer including a toner, and visualized through transferring and fixing. The developers that are used in electrophotography includes a two-component developer including a toner and a carrier, and a single-component developer for which a magnetic toner or a non-magnetic toner is used singly, and the toner is manufactured by a kneading and pulverizing manufacturing method in which a thermoplastic resin is melted, kneaded, cooled, then, finely pulverized, and, furthermore, classified together with a pigment, a charge-controlling agent, and a release agent, such as a wax. For the toner, there are cases in which inorganic or organic particles are added to the surfaces of toner particles as necessary in order to improve fluidity or cleaning properties.

SUMMARY

According to an aspect of the invention, there is provided an electrostatic charge image developing toner including toner particles containing a colorant, a binder resin, and a release agent; and an external additive, in which the external additive contains inorganic particles having hydrocarbon oil that contains a saturated hydrocarbon having a ring structure on the surfaces thereof.

DETAILED DESCRIPTION

Hereinafter, the present exemplary embodiments will be described.

Electrostatic Charge Image Developing Toner

The electrostatic charge image developing toner of the exemplary embodiment (hereinafter also referred to simply as "toner") includes toner particles that contain a colorant, a binder resin and a release agent; and an external additive, in which the external additive contains inorganic particles having hydrocarbon oil that contains a saturated hydrocarbon having a ring structure on the surfaces thereof.

In a developing method in which a two-component developer is used, particularly a magnetic brush method, it is frequently observed that the toner, that is, toner particles and an external additive accumulate and deform in a cleaning section, so as to remain between a cleaning blade and a photoreceptor (image holding member). A phenomenon is shown in which sediment that has remained for a long period of time is fixed to the cleaning blade so as to cause a deterioration of cleaning properties, and filming is caused on the photoreceptor such that an image defect, such as color lines due to toner leakage, is caused. In contrast to this, a method in which a silicone oil-treated external additive is added so as to lower the friction coefficient with a photoreceptor is proposed. However, the inventor and the like found that, when a cartridge or an image forming apparatus is continuously operated for a long period of time in high temperature and humidity conditions or left to stand idle for a long period of time in high temperature and humidity conditions, the silicone oil absorbs moisture, the moisture attaches to the surfaces of the toner or a carrier through silicone oil such that charge-leaked sites are formed, thereby causing image defects, such as fogging.

As a result of detailed studies, the inventor and the like found that hydrocarbon oil containing a saturated hydrocarbon that has a ring structure has poor hygroscopic properties so that moisture is not easily absorbed even in high temperature and humidity conditions, and, when inorganic particles having hydrocarbon oil containing a saturated hydrocarbon that has a ring structure on the surfaces thereof is used as an external additive of the toner, the compound does not easily absorb moisture, and the occurrence of image defects caused by charge leakage is suppressed even in a case in which the electrostatic charge image developing toner is exposed to a high temperature and a high humidity for a long period of time. Furthermore, the hydrocarbon oil containing a saturated hydrocarbon that has a ring structure is also excellent in terms of ability to reduce the friction coefficients with the toner and the photoreceptor, fixation of the toner to the cleaning blade is suppressed, and filming-based image defects are also suppressed. Therefore, the electrostatic charge image developing toner of the exemplary embodiment suppresses both an image defect, such as color lines caused by filming, and an image defect, such as fogging caused by charge leakage, and is excellent in terms of image quality stability.

External Additive

The electrostatic charge image developing toner of the exemplary embodiment contains toner particles and an external additive, and the external additive contains inorganic particles having hydrocarbon oil that contains a saturated hydrocarbon having a ring structure (hereinafter the "saturated hydrocarbon having a ring structure" will be also referred to as "naphthene-based hydrocarbon.") (hereinafter the "hydrocarbon oil containing a saturated hydrocarbon that has a ring structure" will be also referred to as "naphthene-based oil.") on the surfaces thereof.

In the inorganic particles having the naphthene-based oil on the surfaces thereof, the naphthene-based oil needs to be present on at least some of the surfaces of the inorganic particles, but 50% or more of the area of the surfaces of the inorganic particles is preferably coated with the naphthene-based oil, and 80% or more of the area of the surfaces of the inorganic particles is more preferably coated with the naphthene-based oil. Examples of a method of measuring the coating amount of the naphthene-based oil include a method in which the naphthene-based oil is dyed using a dyeing agent of an organic compound or an aromatic compound, the toner or the inorganic particles are photographed, and image-analyzed, thereby calculating an average value of 50 or more inorganic particles.

In addition, the naphthene-based oil is attached to the surfaces of the inorganic particles. That is, the naphthene-based oil may be attached to the surfaces of the inorganic particles by physical adsorption or by bonding through chemical bonds, but the naphthene-based oil is preferably attached to the surfaces of the inorganic particles by physical adsorption. When the naphthene-based oil is attached to the surfaces of the inorganic particles as in the above aspect, occurrence of filming is further suppressed even in a case in which the toner is exposed to a high temperature and a high humidity for a long period of time. In addition, in a case in which the naphthene-based oil is attached by physical adsorption, some of the naphthene-based oil liberates or attaches directly to a carrier, a photoreceptor, or the like from the inorganic particles during use of the toner, thereby further suppressing occurrence of filming.

Hydrocarbon Oil Containing a Saturated Hydrocarbon that has a Ring Structure

The hydrocarbon oil containing a saturated hydrocarbon having a ring structure that is used in the exemplary embodiment (naphthene-based oil) contains a saturated hydrocarbon having a ring structure (naphthene-based hydrocarbon).

The naphthene-based hydrocarbon refers to hydrocarbon having a cycloalkane having a 5-membered ring or a 6-membered ring, such as a cyclopentane ring or a cyclohexane ring, or a cycloalkane structure, and includes a nonsubstituted cyclic saturated hydrocarbon and a cyclic saturated hydrocarbon having a substituent. Examples of the substituent include an alkyl group. The cyclic saturated hydrocarbon may be a monocycle or a polycycle, and is not particularly limited, but is preferably a monocycle in terms of easy procurement. The naphthene-based hydrocarbon preferably has 5 to 50 carbon atoms, more preferably has 5 to 40 carbon atoms, still more preferably 5 to 30 carbon atoms, particularly preferably 5 to 20 carbon atoms, and most preferably 5 to 10 carbon atoms.

Examples of the naphthene-based hydrocarbon include cyclopentane, methylcyclopentane, 1,1-dimethylcyclopentane, 1,3-dimethylcyclopentane, cyclohexane, methylcyclohexane, ethylcyclohexane, 1,2,4-trimethylcyclohexane, and the like.

In the naphthene-based oil of the exemplary embodiment, the content ($C_N$) of the naphthene-based hydrocarbon which is measured based on ASTM D2140 is preferably 30% or more. When the $C_N$ is 30% or more, absorption of moisture into the surface of the toner or the carrier is suppressed due to the steric hindrance of the cyclic saturated hydrocarbon, and leakage of charges is suppressed. In addition, since the cleaning capability in a cleaning section is enhanced due to tangling of molecular chains by the steric hindrance of the cyclic saturated hydrocarbon, occurrence of filming is suppressed, and $C_N$ is preferably 40% or more.

A commercially available product may be used as the naphthene-based oil, and includes SNH8, SNH46, SNH220, SNH440 (all manufactured by Sankyo Yuka Kgyo K.K.), SUNTHENE OIL 310, 410, 415, 450, 480, 4130, 4240, 250J (all manufactured by Japan Sun Oil Company Ltd.), JOMO HS TRANS N (manufactured by JX Nippon Oil & Energy Corporation), BARREL PROCESS OIL 8, 32, 68 (manufactured by Matsumura Oil Co., Ltd.), FUKKOL 1150N, 1400N (all manufactured by Fujikosan Co., Ltd.), and the like.

Inorganic Particles

The inorganic particles having the naphthene-based oil on the surfaces thereof are not particularly limited, and well-known inorganic particles may be used as the external additive of the toner. Examples thereof include silica, alumina, titania (titanium oxide, meta titanium oxide, and the like), cerium oxide, zirconia, calcium carbonate, magnesium carbonate, calcium phosphate, carbon black, and the like.

Among the above, silica particles or titanium oxide particles are preferable, and silica particles are particularly preferable.

The silica particles include silica particles, such as fumed silica, colloidal silica, and silica gel.

In addition, the inorganic particles not only have the naphthene-based oil on the surfaces thereof but also, for example, the surfaces may be treated using a silane coupling agent or the like which will be described below.

The volume average primary particle diameter of the inorganic particles is preferably from 3 nm to 500 nm, more preferably from 5 nm to 100 nm, and still more preferably from 5 nm to 50 nm. Within the above range, the migration properties of a specific saturated hydrocarbon into the carrier, the photoreceptor, or the like are excellent, and occurrence of filming is further suppressed.

The volume average primary particle diameter of the inorganic particles is suitably measured using COULTER MULTISIZER II (manufactured by Beckman Coulter, Inc.).

In addition, in the toner of the exemplary embodiment, the volume average primary particle diameter of the inorganic particles having the naphthene-based oil on the surfaces thereof is preferably larger than the volume average primary particle diameter of the external additive other than the inorganic particles.

In the toner of the exemplary embodiment, the content of the inorganic particles having the naphthene-based oil on the surfaces thereof is not particularly limited, but is preferably from 0.3% by weight to 10% by weight, more preferably from 0.5% by weight to 5% by weight, and still more preferably from 0.8% by weight to 2.0% by weight of the total weight of the toner.

Method of manufacturing the inorganic particles having the naphthene-based oil on the surfaces thereof (surface treatment method)

A method of manufacturing the inorganic particles having the naphthene-based oil on the surfaces thereof is not particularly limited, and a well-known method may be used. In addition, the method does not necessarily include a chemical treatment, and the effects of the exemplary embodiment are sufficiently exhibited even in a state in which the naphthene-based oil is physically adsorbed on the surfaces of the inorganic particles.

Examples of the physical adsorption treatment method include a method of drying through a spray drying method in which the naphthene-based oil or a liquid including the naphthene-based oil is sprayed onto the inorganic particles floating in a gaseous phase or the like, a method in which the inorganic particles are immersed in a solution containing the naphthene-based oil and dried, and the like. In addition, the inorganic particles that have undergone the physical adsorption treatment may be heated, and the surfaces of the inorganic particles may be chemically treated using the naphthene-based oil.

In the toner of the exemplary embodiment, the amount of the naphthene-based oil treated on the inorganic particles (the amount of the naphthene-based oil in the toner) is preferably 0.16% by weight or more, and more preferably 0.20% by weight or more, and preferably 5.5% by weight or less, more preferably 5% by weight or less, and still more preferably 2% by weight or less of the total weight of the toner. Within the above range, image quality stability is superior.

Examples of a method of adding the external additive to the toner of the exemplary embodiment include a method in which toner particles and the external additive are mixed using a Henschel mixer, a V blender, or the like so as to manufacture the inorganic particles. In addition, in a case in which toner particles are manufactured in a wet manner, it is also possible to add the external additive in a wet manner.

In addition, a method is also included in which, after the inorganic particles are added to the toner particles, the naphthene-based oil or a liquid including the naphthene-based oil is added, and the mixture is mixed using a Henschel mixer, a V blender, or the like.

Among the above, the method of manufacturing the inorganic particles through a physical adsorption treatment is preferable as the method of manufacturing the inorganic particles having the naphthene-based oil on the surface thereof.

Other External Additives

The toner of the exemplary embodiment may include external additives other than the inorganic particles having the naphthene-based oil on the surfaces thereof (also referred to as "other external additives").

The content of other external additives in the toner of the exemplary embodiment is preferably smaller than that of the inorganic particles having the naphthene-based oil on the surfaces thereof.

Examples of other external additives include inorganic particles described above and resin particles of a vinyl-based resin, a polyester resin, a silicone resin, and the like.

The inorganic particles in other external additives are preferably hydrophobilized on the surfaces in advance. The hydrophobilization treatment is more effective for not only improvement of the powder fluidity of the toner, but also the environment reliance of charge and carrier contamination resistance.

The hydrophobilization treatment is carried out by immersing the inorganic particles in a hydrophobilization treatment agent, or the like. The hydrophobilization treatment agent is not particularly limited, and examples thereof include a silane coupling agent, a titanate coupling agent, an aluminum coupling agent, and the like. The hydrophobilization treatment agent may be used singly, or two or more kinds may be used in combination. Among the above, a silane coupling agent is preferably used.

Examples of the silane coupling agent that may be used include any type of chlorosilane, alkoxy silane, silazane, special silylation agents.

Specific examples include methyl trichlorosilane, dimethyl dichlorosilane, trimethyl chlorosilane, phenyl trichlorosilane, diphenyl dichlorosilane, tetramethoxy silane, methyltrimethoxy silane, dimethyldimethoxy silane, phenyltrimethoxy silane, diphenyldimethoxy silane, tetraethoxy silane, methyltriethoxy silane, dimethyldiethoxy silane, phenyltriethoxy silane, diphenyldiethoxy silane, isobutyltriethoxy silane, decyltrimethoxy silane, hexamethyl disilazane, N,O-(bistrimethylsilyl)acetamide, N,N-(trimethylsilyl)urea, tert-butyldimethyl chlorosilane, vinyl trichlorosilane, vinyltrimethoxy silane, vinyltriethoxy silane, γ-methacryloxypropyl trimethoxysilane, β-(3,4-epoxycyclohexyl)ethyltrimethoxy silane, γ-glycidoxypropyl trimethoxy silane, γ-glycidoxypropylmethyl diethoxysilane, γ-mercaptopropyl trimethoxysilane, γ-chloropropyl trimethoxysilane, and the like.

The amount of the hydrophobilization treatment agent changes by the kind of the inorganic particles and the like, and may not be generally specified. However, the amount is preferably 1 part by weight to 50 parts by weight, and more preferably 5 parts by weight to 20 parts by weight with respect to 100 parts by weight of the inorganic particles. Meanwhile, in the exemplary embodiment, a commercially available product is also preferably used as the hydrophobic silica particles.

The average primary particle diameter of other external additives is preferably from 3 nm to 500 nm, more preferably from 5 nm to 100 nm, and still more preferably from 5 nm to 50 nm.

Toner Particles

The electrostatic charge image developing toner of the exemplary embodiment contains toner particles containing a colorant, a binder resin, and a release agent. In addition, the toner particles may further contain a well-known additive, such as a charge-controlling agent.

Binder Resin

The binder resin includes polyolefin resins, such as polyethylene and polypropylene, styrene resins mainly including polystyrene, poly(α-methylstyrene), or the like, (meth)acryl resins mainly including polymethyl methacrylate, polyacrylonitrile, or the like, styrene-(meth)acryl copolymer resins, polyamide resins, polycarbonate resins, polyether resins, polyester resins, and copolymer resins thereof, but styrene resins, (meth)acryl resins, styrene-(meth)acryl copolymer resins, and polyester resins are preferable from the viewpoint of charge stability and developing durability when being used for the electrostatic charge image developing toner.

The binder resin preferably contains a polyester resin, and more preferably contains an amorphous (non-crystalline) polyester resin from the viewpoint of low-temperature fixing properties.

The polyester resin is obtained through, for example, condensation polymerization of mainly a polyvalent carboxylic acid and a polyol.

Examples of the polyvalent carboxylic acid include aromatic carboxylic acids, such as terephthalic acid, isophtalic acid, phthalic anhydride, trimellitic anhydride, pyromellitic acid, and naphthalene dicarboxylic acid; aliphatic carboxylic acids, such as maleic anhydride, fumaric acid, succinic acid, alkenyl succinic anhydride, and adipic acid; alicyclic carboxylic acids, such as cyclohexane dicarboxylic acid; lower alkyl esters or anhydrides thereof. Meanwhile, the lower alkyl esters refer to a straight-chain, branched, or cyclic alkyl group having 1 to 8 carbon atoms. The polyvalent carboxylic acid may be used singly, or two or more kinds may be used in combination. Among the polyvalent carboxylic acids, the aromatic carboxylic acid is preferably used. In addition, a tri- or more-valent carboxylic acid (trimellitic acid, anhydride thereof, or the like) is preferably used jointly with a dicarboxylic acid in order to have a crosslinking structure or a branched structure for the purpose of securing favorable fixing properties.

The polyvalent carboxylic acid used to obtain the amorphous polyester resin includes aromatic dicarboxylic acids, such as phthalic acid, isophtalic acid, terephthalic acid, naphthalene-2,6-dicarboxylic acid, 1,4-phenylene diacetate, and 1,4-cyclohexane dicarboxylic acid; dicarboxylic acids having alicyclic hydrocarbon group, and the like, and also includes acid anhydrides thereof and lower alkyl esters.

Examples of the polyol include aliphatic diols, such as ethylene glycol, diethylene glycol, triethylene glycol, propylene glycol, butanediol, hexanediol, neopentyl glycol, and glycerin; alicyclic diols, such as cyclohexanediol, cyclohexanedimethanol, and hydrogenated bisphenol A; aromatic diols, such as ethylene oxide adducts of bisphenol A and propylene oxide adducts of bisphenol A. The polyol may be used singly, or two or more kinds may be used in combination.

Preferable examples of the polyol used to obtain the amorphous polyester include aliphatic, alicyclic, and aromatic polyols, and specific examples include 1,4-cyclohexanediol, 1,4-cyclohexanedimethanol, alkylene oxide adducts of bisphenol A, alkylene oxide adducts of bisphenol Z, alkylene oxide adducts of hydrogen-added bisphenol A, and the like. Among the above, an alkylene oxide adduct of bisphenol A may be preferably used, and an adduct of 2 moles of bisphenol A ethylene oxide and an adduct of 2 moles of bisphenol A propylene oxide may be more preferably used.

In addition, a tri- or more-valent alcohol (for example, glycerine, trimethylol propane, pentaerythritol, or the like) may be used jointly with a diol in order to have a crosslinking structure or a branched structure for the purpose of securing more favorable fixing properties.

The glass transition temperature (hereinafter sometimes abbreviated to be "Tg") of the amorphous polyester resin is preferably from 50° C. to 80° C., and more preferably from 50° C. to 70° C. When Tg is 80° C. or lower, the low-temperature fixing properties are excellent, which is preferable. In addition, when Tg is 50° C. or higher, the heat preservation resistance is excellent, and the preservation properties of fixed images are excellent, which is preferable.

The acid value of the amorphous polyester resin is preferably from 5 mgKOH/g to 25 mgKOH/g, and more preferably from 6 mgKOH/g to 23 mgKOH/g. When the acid value is 5 mgKOH/g or more, the affinity of the toner to paper is favorable, and the charging properties are also favorable. In addition, in a case in which the toner is manufactured by an emulsion aggregation method described below, emulsified particles are easily manufactured, the large acceleration of the aggregation rate during aggregation or the shape change rate during coalescence of the emulsion aggregation method is suppressed, and particle sizes and shapes are easily controlled. In addition, when the acid value of the amorphous polyester resin is 25 mgKOH/g or less, the environment reliance of charging is not adversely influenced. In addition, the large deceleration of the aggregation rate during aggregation or the shape change rate during coalescence while manufacturing the toner by the emulsion aggregation method is suppressed, and deterioration of the productivity is prevented.

For the amorphous polyester resin, when molecular weights are measured by the gel permeation chromatography (GPC) of tetrahydrofuran (THF) soluble, the weight average molecular weight (Mw) is preferably from 5,000 to 1,000,000, and more preferably from 7,000 to 500,000, the number average molecular weight (Mn) is preferably from 2,000 to 100,000, and the molecular weight distribution Mw/Mn is preferably from 1.5 to 100, and more preferably 2 to 60.

When the molecular weight and molecular weight distribution of the amorphous polyester resin are within the above ranges, excellent fixed image strength may be obtained without impairing the low-temperature fixing properties, which is preferable.

In the exemplary embodiment, the toner particles may include a crystalline polyester resin.

The crystalline polyester resin is melted with the amorphous polyester resin during melting so as to largely lower the toner viscosity, thereby obtaining a toner having more favorable low-temperature fixing properties. In addition, among the crystalline polyester resins, since many aromatic crystalline polyester resins are generally melted at a higher temperature than the melting temperature range described below, the crystalline polyester resin is more preferably an aliphatic crystalline polyester resin in a case in which the toner particles includes the crystalline polyester resin.

In the exemplary embodiment, the content of the crystalline polyester resin in the toner particles is preferably from 2% by weight to 30% by weight, and more preferably from 4% by weight to 25% by weight. When the content is 2% by weight or more, it is possible to decrease the viscosity of the amorphous polyester resin during melting, and the low-temperature fixing properties may be easily improved. In addition, when the content is 30% by weight or less, deterioration of the charging properties of the toner which is caused by the presence of the crystalline polyester resin is prevented, and, furthermore, high image strength may be easily obtained after the toner is fixed to a recording medium.

The melting temperature of the crystalline polyester resin is preferably in a range of 50° C. to 90° C., more preferably in a range of 55° C. to 90° C., and still more preferably in a range of 60° C. to 90° C. When the melting temperature is 50° C. or higher, the preservation properties of the toner or the preservation properties of the fixed toner images are excellent. In addition, when the melting temperature is 90° C. or lower, the low-temperature fixing properties improve.

On the other hand, the glass transition temperature (Tg) of the amorphous polyester resin is preferably 30° C. or higher, more preferably from 30° C. to 100° C., and still more preferably from 50° C. to 80° C. Within the above ranges, since the crystalline polyester resin is in a glass state while being used, toner particles are not aggregated due to heat or pressure applied during formation of an image, and a stable image forming ability may be obtained for a long period of time without the toner particles being attached to and accumulated in a machine.

The glass transition temperature of the resin may be measured by a well-known method, for example, the method described in ASTM D3418-82 (DSC method).

The melting point of the crystalline resin is measured using a differential scanning calorimeter (DSC), and may be obtained as a melting peak temperature of input compensation differential scanning calorimetry shown in JIS K-7121 when measurement is carried out at a temperature-increase rate of 10° C./minute from room temperature to 150° C.

Meanwhile, the "crystalline" as shown in the crystalline resin indicates that the resin does not show endothermic change in a stair-like shape, but has a clear endothermic peak, and specifically means that the half-value width of the endothermic peak is 15° C. or less when measurement is carried out at a temperature-increase rate of 10° C./minute.

On the other hand, a resin for which the half-value width of the endothermic peak exceeds 15° C. and a resin for which a clear endothermic peak is not observed indicate that they are not crystalline (amorphous). The glass transition temperature by DSC of the amorphous resin is measured based on ASTM D3418 using a differential scanning calorimeter (DSC-50 manufactured by Shimadzu Corporation) having an automatic tangential treatment system or the like. The measurement conditions are as follows.

Sample: 3 mg to 15 mg, preferably 5 mg to 10 mg

Measurement method: the sample is put into an aluminum pan, and an empty aluminum pan is used as a reference.

Temperature curve: temperature increase I (20° C. to 180° C., temperature-increase rate 10° C./min)

In the above temperature curve, the glass transition temperature is measured from the endothermic curve measured during temperature increase.

The glass transition temperature is a temperature at which the differential value of the endothermic curve becomes the maximum.

In addition, in a case in which the crystalline polyester resin is a polymer in which other components are copolymerized with the main chain, or in a case in which other components are less than 50% by weight, the copolymer is also termed a crystalline polyester.

The acid component used for synthesis of the crystalline polyester resin includes a variety of polyvalent carboxylic acids, but a dicarboxylic acid is preferable, and a straight chain-type aliphatic dicarboxylic acid is more preferable.

Examples thereof include oxalic acid, malonic acid, succinic acid, glutaric acid, adipic acid, pimelic acid, suberic acid, azelaic acid, sebacic acid, 1,9-nonane dicarboxylic acid, 1,10-decan dicarboxylic acid, 1,11-undecan dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-ocatadecane dicarboxylic acid, and the like, lower alkyl esters or acid anhydrides thereof, but the acid component is not limited to the examples. Among the above, adipic acid, sebacic acid, and 1,10-decane dicarboxylic acid are preferable in consideration of easy procurement.

In addition, as the acid component used for synthesis of the crystalline polyester resin, dicarboxylic acid having an ethylenic unsaturated bond or dicarboxylic acid having a sulfonic acid group may be used.

Aliphatic diols are preferable as the alcohol component used for synthesis of the crystalline polyester resin, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, 1,20-eicosanediol, and the like, but the alcohol component is not limited to the examples. Among the above, 1,4-butanediol, 1,6-hexanediol, 1,8-octanediol, 1,9-nonanediol, and 1,10-decanediol are preferable in consideration of easy procurement or costs.

The molecular amount (weight average molecular weight; Mw) of the crystalline polyester resin is preferably from 8,000 to 40,000, and more preferably from 10,000 to 30,000 from the viewpoint of the manufacturability of the resin, fine dispersion of the toner during manufacturing, and the compatibility during melting. When the weight average molecular weight is 8,000 or more, deterioration of the electric resistance of the crystalline polyester resin is suppressed, and therefore deterioration of the charging properties is prevented. In addition, when the weight average molecular weight is 40,000 or less, costs for resin synthesis is suppressed, and deterioration of the sharp melting properties is prevented, and therefore the low-temperature fixing properties are not adversely influenced.

In the exemplary embodiment, the molecular weight of the polyester resin is measured and calculated by gel permeation chromatography (GPC). Specifically, for the measurement, a HLC-8120 manufactured by Tosoh Corporation is used as the GPC, a TSKgel Super HM-M (15 cm) manufactured by Tosoh Corporation is used as the column, and a polyester resin is measured using the THF solvent. Next, the molecular weight of the polyester resin is calculated using a molecular weight correction curve produced from a single-dispersion polystyrene standard sample.

A method of manufacturing the polyester resin is not particularly limited, and the polyester resin may be manufactured by a general polyester polymerization method in which the acid component and the alcohol component are reacted with each other. For example, any of direct condensation polymerization, an ester exchange method, and the like are selected depending on the kind of a monomer so as to manufacture the polyester resin. When the acid component and the alcohol component are reacted with each other, since the molar ratio (the acid component/the alcohol component) changes by reaction conditions and the like, it is not possible to specify a comprehensive molar ratio, but the molar ratio is, generally, preferably approximately 1/1 in order to increase the molecular weight.

The catalyst that may be used to manufacture the polyester resin includes alkali metal compounds of sodium, lithium, and the like; alkaline earth metal compounds of magnesium, calcium, and the like, metal compounds of zinc, manganese, antimony, titanium, tin, zirconium, germanium, and the like; phosphite compounds, phosphate compounds, amine compounds, and the like.

A styrene resin and a (meth)acryl resin, particularly, a styrene-(meth)acryl copolymer resin is useful as the binder resin in the exemplary embodiment.

Latex having a copolymer obtained by polymerizing a monomer mixture including 60 parts by weight to 90 parts by weight of a vinyl aromatic monomer (styrene monomer), 10 parts by weight to 40 parts by weight of ethylenic unsaturated carboxylic acid ester monomer ((meth)acrylic acid ester monomer), and 1 part by weight to 3 parts by weight of an ethylenic unsaturated acid monomer dispersed and stabilized using a surfactant may be preferably used as the binder resin component.

The glass transition temperature of the copolymer is preferably from 50° C. to 70° C.

Hereinafter, polymerizable monomers that compose the copolymer resin will be described.

The styrene monomer includes alkyl-substituted styrene having an alkyl chain, such as styrene, α-methyl styrene, vinyl naphthalene, 2-methyl styrene, 3-methyl styrene, 4-methyl styrene, 2-ethyl styrene, 3-ethyl styrene, and 4-ethyl styrene; halogen-substituted styrene, such as 2-chlorostyrene, 3-chlorostyrene, and 4-chlorostyrene; fluorine-substituted styrene, such as 4-fluorostyrene and 2,5-difluorostyrene; and the like. Among the above, styrene is preferable as the styrene monomer.

The (meth)acrylate ester monomer includes n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth) acrylate, isobutyl (meth)acrylate, t-butyl (meth)acrylate, isopentyl (meth)acrylate, amil (meth)acrylate, neopentyl (meth) acrylate, isohexyl (meth)acrylate, isoheptyl (meth)acrylate, isooctyl (meth)acrylate, 2-ethyl hexyl (meth)acrylate, phenyl (meth)acrylate, biphenyl (meth)acrylate, diphenyl ethyl (meth)acrylate, t-butyl phenyl (meth)acrylate, terphenyl (meth)acrylate, cyclohexyl (meth)acrylate, t-butyl cyclohexyl (meth)acylate, dimethyl amino ethyl (meth)acrylate, diethyl amino ethyl (meth)acrylate, methoxy ethyl (meth) acrylate, 2-hydroxy ethyl (meth)acrylate, β-carboxy ethyl (meth)acrylate, (meth)acrylonitrile, (meth)acrylamide, and the like. Among the above, n-butyl acrylate is preferable as the (meth)acrylate ester monomer.

The ethylenic unsaturated acid monomer is an ethylenic unsaturated monomer containing an acidic group, such as a carboxyl group, a sulfonic acid group, or an acid anhydride.

In a case in which the styrene resin, the (meth)acryl resin, and the styrene-(meth)acryl copolymer resin contain a carboxyl group, it is possible to obtain the resin by copolymerizing polymerizable monomers having a carboxylic group.

Specific examples of the carboxylic group-containing polymerizable monomer include acrylic acid, aconitic acid, atropic acid, arylmalonic acid, angelic acid, isocrotonic acid, itaconic acid, 10-undecenic acid, elaidic acid, erucic acid, oleic acid, o-carboxycinnamic acid, crotonic acid, chloroacryl acid, chloroisocrotonic acid, chlorocrotonic acid, chlorofumaric acid, chloromaleic acid, cinnamic acid, cyclohexene dicarboxylic acid, citraconic acid, hydroxy cinnamic acid, dihydroxy cinnamic acid, tiglic acid, nitro cinnamic acid, vinyl acetate, phenyl cinnamic acid, 4-phenyl-3-butenic acid, ferulic acid, fumaric acid, brassidic acid, 2-(2-furyl) acrylic acid, bromo cinnamic acid, bromo fumaric acid, bromo maleic acid, bendilidene maloic acid, benzoyl acrylic acid, 4-pentenoic acid, maleic acid, mesaconic acid, methacylic acid, methyl cinnamic acid, methoxy cinnamic acid, and the like. Among the above, acrylic acid, methacrylic acid, maleic acid, cinnamic acid, and fumaric acid are preferable and acrylic acid is more preferable in terms of ease of a polymer-forming reaction or the like.

A chain transfer agent may be used when the binder resin is polymerized.

The chain transfer agent is not particularly limited, and a compound having a thiol component may be used. Specifically, alkyl mercaptanes, such as hexyl mercaptane, heptyl mercaptane, octyl mercaptane, nonyl mercaptane, decyl mercaptane, and dodecyl mercaptane, are preferable. They are preferable particularly because the molecular weight distribution is narrow, and thus the preservation properties of the toner at a high temperature become favorable.

A crosslinking agent may be added to the binder resin as necessary. The crosslinking agent is typically a multifunctional monomer having 2 or more ethylenic unsaturated groups in the molecule.

Specific examples of the crosslinking agent include aromatic polyvinyl compounds, such as divinyl benzene and divinyl naphthalene; polyvinyl esters of aromatic polyvalent carboxylic acid, such as divinyl phthalate, divinyl isophthalate, divinyl terephthalate, divinyl homophthalate, divinyl/trivinyl trimesate, divinyl naphthalene dicarboxylate, and divinyl biphenyl carboxylate; divinyl esters of nitrogen-containing aromatic compounds, such as divinyl pyridine dicarboxylate; vinyl esters of unsaturated heterocyclic carboxylic acids, such as vinyl pyromucate, vinyl furan carboxylate, vinyl pyrrole-2-carboxylate, and vinyl thiophene carboxylate; (meth)acrylates of linear polyols, such as butanediol methacrylate, hexanediol acrylate, octanediol methacrylate, decanediol acrylate, and dodecanediol methacrylate; branched and substituted polyol (meth)acrylates, such as neopentyl glycol dimethacrylate and 2-hydroxy-1,3-diacryloxy propane; and polyvalent polyvinyl esters of polyvalent carboxylic acid, such as polyethylene glycol di(meth)acrylate, polypropylene polyethylene glycol di(meth)acrylates, divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, dodecanedioic acid divinyl, divinyl brassylate, and the like.

In the exemplary embodiment, the crosslinking agent may be used singly, or two or more kinds may be used in combination.

The content of the crosslinking agent is preferably in a range of 0.05% by weight to 5% by weight, and more preferably in a range of 0.1% by weight to 1.0% by weight of the total amount of the polymerizable monomer.

Among the binder resins, binder resins that may be manufactured through radical polymerization of polymerizable monomers may be polymerized using a radical polymerization initiator.

The radical polymerization initiator is not particularly limited, and specific examples thereof include peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, peroxy carbonate diisopropyl, tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, and tert-butyl perN-(3-toluoyl)carbamate; azo compounds, such as 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, 4-nitrophenylazobenzylcyanoacetate, phenyl azodiphenyl methane, phenyl azotriphenyl methane, 4-nitrophenyl azotriphenyl methane, 1,1'-azobis-1,2-diphenyl ethane, poly(bisphenol A-4,4'-azobis-4-cyanopentanoate) and poly(tetraethyleneglycol-2,2'-azobisisobutyrate); 1,4-bis(pentaethylene)-2-tetrazene, 1,4-dimethoxycarbonyl-1,4-diphenyl-2-tetrazene, and the like.

In addition, the crystalline vinyl resin includes vinyl resins using (meth)acrylate esters of a long-chain alkyl or alkenyl, such as amyl(meth)acrylate, hexyl(meth)acrylate, heptyl (meth)acrylate, octyl(meth)acrylate, nonyl(meth)acrylate, decyl(meth)acrylate, undecyl(meth)acrylate, tridecyl(meth) acrylate, myristyl(meth)acrylate, cetyl(meth)acrylate, stearyl (meth)acrylate, oleyl(meth)acrylate, and behenyl(meth)acrylate. Meanwhile, in the present specification, the term "(meth) acryl" means inclusion of any or both of "acryl" and "methacryl."

In addition, the weight average molecular weight of the addition polymerization resin, such as styrene resins and (meth)acryl resins, is preferably from 5,000 to 50,000 and more preferably from 7,000 to 35,000. When the weight average molecular weight is 5,000 or more, the cohesive force of the binder resin is favorable, and the hot offset properties do not deteriorate. In addition, when the weight average molecular weight is 50,000 or less, favorable hot offset properties and a favorable lowest fixing temperature may be obtained, the time or temperature necessary for condensation polymerization is appropriate, and manufacturing efficiency is favorable.

Meanwhile, the weight average molecular weight of the binder resin may be measured through, for example, gel permeation chromatography (GPC) and the like.

The content of the binder resin in the toner of the exemplary embodiment is not particularly limited, but is preferably from 10% by weight to 95% by weight, more preferably from 25% by weight to 90% by weight, and still more preferably from 45% by weight to 85% by weight with respect to the total weight of the toner. Within the above ranges, fixing properties, charge characteristics, and the like are excellent.

Colorant

The toner particles contain a colorant.

Examples of the colorant that may be used for the toner of the exemplary embodiment include one kind or a combination of two or more kinds of magnetic powder of magnetite, ferrite, and the like; a variety of pigments, such as carbon black, lampblack, chrome yellow, hanza yellow, benzidine yellow, threne yellow, quinoline yellow, permanent orange GTR, pyrazolone orange, vulcan orange, Watchung red, permanent red, brilliant carmine 3B, brilliant carmine 6B, DuPont oil red, pyrazolone red, lithol red, rhodamine B lake, lake red C, rose Bengal, aniline blue, ultramarine blue, chalco oil blue, methylene blue chloride, phthalocyanine blue, phthalocyanine green, and malachite green oxalate; a variety of dyes based on acridine, xanthene, azo, benzoquinone, azine, anthraquinone, thioindigo, dioxazine, thiazine, azomethine, indigo, phthalocyanine, aniline black, polymethine, triphenyl methane, diphenyl methane, thiazole, and xanthene.

In addition, examples thereof include C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3, and the like.

The content of the colorant in the toner particles is preferably in a range of 1 part by weight to 30 parts by weight with respect to 100 parts by weight of the binder resin in the toner particles. In addition, it is also effective to use a surface-treated colorant or a pigment dispersing agent as necessary. A toner having a variety of colors, such as a yellow toner, a magenta toner, a cyan toner, and a black toner, may be obtained by appropriately selecting the kinds of the colorant.

Release Agent

The toner particles contain a release agent.

The release agent used in the exemplary embodiment is not particularly limited, a well-known release agent may be used, and the following waxes are preferable.

The waxes include a paraffin wax and derivatives thereof, a montan wax and derivatives thereof, a microcrystalline wax and derivatives thereof, a Fischer Tropsch wax and derivatives thereof, a polyolefin wax and derivatives thereof, and the like. The derivatives include oxides, polymers of vinyl monomers, and graft denaturants. Additionally, an alcohol, an aliphatic acid, a plant wax, an animal wax, a mineral wax, an ester wax, an acid amide, and the like may also be used.

The wax used as the release agent melts at any temperature of 70° C. to 140° C., and preferably shows a melting viscosity of 1 centipoise to 200 centipoises, and more preferably a melting viscosity of 1 centipoise to 100 centipoises. When the wax melts at 70° C. or higher, the change temperature of the wax is sufficiently high, and the blocking resistance and the developing properties when the temperature inside a copying machine is increased are excellent. When the wax melts at 140° C. or lower, the change temperature of the wax is sufficiently low, it is not necessary to carry out fixing at a high temperature, and energy saving properties are excellent. In addition, when the melting viscosity is 200 centipoises or less, the degree of ejection from the toner is appropriate, and the fixing peeling properties are excellent.

In the toner of the exemplary embodiment, the release agent is selected from the viewpoint of fixing properties, toner blocking properties, toner strength, and the like. The added amount of the release agent is not particularly limited, but is preferably in a range of 2 parts by weight to 20 parts by weight with respect to 100 parts by weight of the binder resin included in the toner particles.

Other Additives

In addition to the above components, a variety of components, such as an internal additive and a charge-controlling agent, may be further added to the coloring particles as necessary.

Examples of the internal additive include magnetic articles, such as metals, such as ferrite, magnetite, reduced iron, cobalt, nickel, and manganese, alloys, or compounds including the metals.

Examples of the charge-controlling agent include quaternary ammonium salts, nigrosine compounds, dyes including a complex, such as aluminum, iron, or chromium, triphenyl methane pigments, and the like.

The toner particles used in the exemplary embodiment is not particularly limited by the manufacturing method, and may be manufactured by a well-known method. Specific examples include the following methods.

The toner particles may be manufactured by, for example, a kneading and pulverizing method in which the binder resin, the colorant, the release agent, the charge-controlling agent as necessary, and the like are kneaded, pulverized, and classified; a method in which the shapes of particles obtained by the kneading and pulverizing method are changed through a mechanical impulsive force or heat energy; an emulsion aggregation method in which a dispersion liquid obtained by emulsifying and dispersing the binder resin and a dispersion liquid of the colorant, the release agent, the charge-controlling agent as necessary, and the like are mixed, aggregated, heated, and melted so as to obtain toner particles; an emulsion polymerization aggregation method in which polymerizable monomers of the binder resin are emulsion-polymerized, the formed dispersion liquid and a dispersion liquid of the colorant, the release agent, the charge-controlling agent as necessary, and the like are mixed, aggregated, heated, and melted so as to obtain toner particles; a suspension polymerization method in which polymerizable monomers for obtaining the binder resin and a solution of the colorant, the release agent, the charge-controlling agent as necessary, and the like are suspended in an aqueous solvent so as to polymerize the monomers; a dissolution suspension method in which the binder resin and a solution of the colorant, the release agent, the charge-controlling agent as necessary, and the like are suspended in an aqueous solvent so as to granulate the binder resin; or the like. In addition, the toner particles may be manufactured by a method in which the toner particles obtained by the above method are used as cores, and, furthermore, aggregated particles are attached, heated, and coalesced so as to produce a core shell structure.

Among the above, the toner of the exemplary embodiment is preferably a toner (emulsion aggregation toner) obtained by the emulsion aggregation method or the emulsion polymerization aggregation method.

The particle diameter of the toner manufactured in the above manner is preferably in a range of 2 μm to 8 μm, and more preferably in a range of 3 μm to 7 μm in terms of volume average particle diameter. When the volume average particle diameter is 2 μm or more, since the fluidity of the toner is favorable and sufficient charging ability is supplied from the carrier, fogging in the background portion does not easily occur, and concentration reproducibility does not easily deteriorate. In addition, when the volume average particle diameter is 8 μm or less, the effect of improving the reproducibility, tone, and granularity of fine dots is favorable, and a high-quality image may be obtained. Meanwhile, the volume average particle diameter is measured using a measurement device, such as a COULTER MULTISIZER II (manufactured by Beckman Coulter, Inc.).

The toner particles are preferably pseudospherical from the viewpoint of improvement in reproducibility, transfer efficiency, and image quality. The degree of spheroidizing of the toner particles may be expressed using the shape factor SF1 in the formula shown below, but the average value (average shape factor) of the shape factor SF1 of the toner particles used in the exemplary embodiment is preferably less than 145, more preferably in a range of 115 to less than 140, and still more preferably in a range of 120 to less than 140. When the average value of the shape factor SF1 is less than 145, favorable transfer efficiency may be obtained, and the image quality is excellent.

$$SF1 = \frac{(ML)^2}{A} \times \frac{\pi}{4} \times 100$$

In the above formula, ML represents the maximum length of the respective toner particles, and A represents the projection area of the respective toner particles.

Meanwhile, the average value of the shape factor SF1 (average shape factor) is obtained by scanning the toner images of 1,000 particles at a magnification of 250 times to an image analyzer (LUZEX III, manufactured by Nireco Corporation) from an optical microscope, obtaining the SF1 values of the respective particles from the maximum lengths and the projection areas, and averaging the values.

Electrostatic Charge Image Developer

The electrostatic charge image developing toner of the exemplary embodiment is suitably used as an electrostatic charge image developer.

The electrostatic charge image developer of the exemplary embodiment is not particularly limited as long as the electrostatic charge image developer contains the electrostatic charge image developing toner of the exemplary embodiment, and may have an appropriate component composition according to the purpose. When the electrostatic charge image developing toner of the exemplary embodiment is used singly, a single-component electrostatic charge image developer is prepared, and, when the electrostatic charge image developing toner of the exemplary embodiment is used in combination with a carrier, a two-component electrostatic charge image developer is prepared.

When the single-component developer is used, a method in which the electrostatic charge image developing toner is friction-charged with a developing sleeve or a charging member so as to form a charged toner, and the toner is developed according to an electrostatic latent image is also applied.

In the exemplary embodiment, the developing method is not particularly specified, but the two-component developing method is preferable. In addition, when the above conditions are satisfied, the carrier is not particularly specified, but examples of the core material of the carrier include magnetic metals, such as iron, steel, nickel, and cobalt, alloys of the above and manganese, chromium, a rare earth element, or the like, magnetic oxides, such as ferrite and magnetite, and the like, but ferrite, particularly an alloy with manganese, lithium, strontium, magnesium, or the like is preferable from the viewpoint of core material surface properties and core material resistance.

The carrier used in the exemplary embodiment preferably has a resin coated on the surface of the core material. The resin is not particularly limited, and appropriately selected according to the purpose. Examples thereof include well-known resins, such as polyolefin resins, such as polyethylene and polypropylene; polyvinyl resins and polyvinylidene resins, such as polystyrene, an acryl resin, polyacrylonitrile, polyvinyl acetate, polyvinyl alcohol, polyvinyl butyral, polyvinyl chloride, polyvinyl carbazole, polyvinyl ether, and polyvinyle ketone; vinyl chloride-vinyl acetate copolymer; styrene-acrylate copolymer; straight silicone resins including an organosiloxane bond and denatures thereof; fluorine resins, such as polytetrafluoroethylene, polyvinyl fluoride, polyvinylidene fluoride, and polychlorotrifluoroethylene; a silicone resin; polyester; polyurethane; polycarbonate; a phenol resin; amino resins, such as a urea-formaldehyde resin, a melamine resin, a benzoguanamine resin, a urea resin, and a polyamide resin; and an epoxy resin. The resin may be used singly, or two or more kinds may be used in combination. In the exemplary embodiment, among the above resins, at least the fluorine resins and/or the silicone resin are preferably used. When at least the fluorine resins and/or the silicone resin are used as the resin, the effect of preventing carrier contamination (infection) due to the toner or the external additive is favorable, which is advantageous.

A film formed of the resin preferably has resin particles and/or conductive particles dispersed in the resin. Examples of the resin particles include thermoplastic resin particles, thermosetting resin particles, and the like. Among the above, a thermosetting resin is preferable from the viewpoint of a relatively easy increase in the hardness, and resin particles of a nitrogen-containing resin containing N atoms are preferable from the viewpoint of supplying negative chargeability to the toner. Meanwhile, the resin particles may be used singly, or two or more kinds may be used in combination. The average particle diameter of the resin particles is preferably from 0.1 μm to 2 and more preferably from 0.2 μm to 1 μm. When the average particle diameter of the resin particles is 0.1 μm or more, the dispersibility of the resin particles in the film is excellent, and, on the other hand, when the average particle diameter of the resin particles is 2 μm or less, the resin particles do not easily fall off from the film.

The conductive particles include metal particles of gold, silver, copper, and the like, carbon black particles, furthermore, particles in which the surfaces of titanium oxide, zinc oxide, barium sulfate, aluminum borate, potassium titanate powder, or the like are coated with tin oxide, carbon black, metals, or the like. The conductive particles may be used singly, or two or more kinds may be used in combination. Among the above, carbon black particles are preferable in terms of favorable manufacturing stability, costs, conductivity, and the like. The kind of the carbon black is not particularly limited, but carbon black having a DBP oil absorption of 50 ml/100 g to 250 ml/100 g is preferable since the manufacturing stability is excellent. The amounts of the resin, the resin particles, and the conductive particles coated on the surface of the core material are preferably from 0.5% by weight to 5.0% by weight, and more preferably from 0.7% by weight to 3.0% by weight.

A method of forming the film is not particularly limited, but examples thereof include a method in which the resin particles, such as crosslinking resin particles, and/or the conductive particles, and a film-forming liquid including the resin, such as a styrene acryl resin, a fluorine resin, a silicone resin, or the like as a matrix resin in a solvent are used.

Specific examples thereof include an immersion method in which the carrier core material is immersed in the film-forming liquid, a spray method in which the film-forming liquid is sprayed onto the surface of the carrier core material, a kneader coater method in which the film-forming liquid is mixed in a state in which the carrier core material is floated using air flow, and the solvent is removed, and the like. Among the above, in the exemplary embodiment, the kneader coater method is preferable.

The solvent used in the film-forming liquid is not particularly limited as long as the solvent may dissolve the resin as the matrix resin, and may be selected from well-known solvents. Examples of the solvent include aromatic hydrocarbons, such as toluene and xylene; ketones, such as acetone and methyl ethyl ketone; ethers, such as tetrahydrofuran and dioxane; and the like. In a case in which the resin particles are dispersed in the film, since the particles are uniformly dispersed as the resin particles and the matrix resin in the thickness direction and the tangential direction to the carrier surface, even when the carrier is used for a long period of time such that the film is worn, the same surface formation may be held as before use, and favorable charging supply ability may be maintained for a long period of time with respect to the toner. In addition, in a case in which the conductive particles are dispersed in the film, since the resin is uniformly dispersed as the conductive particles and the matrix resin in the thickness direction and the tangential direction to the carrier surface, even when the carrier is used for a long period of time such that the film is worn, the same surface formation may be held as before use, and deterioration of the carrier is prevented for a long period of time. Meanwhile, in a case in which the resin particles and the conductive particles are dispersed in the film, the above effects are exhibited at the same time.

The electrical resistance of the entire magnetic carrier formed in the above manner is preferably from $10^8$ Ωcm to $10^{13}$ Ωcm in a state of magnetic brush under an electric field of $10^4$ V/cm. When the electrical resistance of the magnetic carrier is $10^8$ Ωcm or more, attachment of the carrier to the image portion on the image holding member is suppressed, and brush marks are not easily generated. On the other hand, when the electrical resistance of the magnetic carrier is $10^{13}$ Ωcm or less, occurrence of the edge effect is suppressed, and favorable image quality may be obtained.

Meanwhile, the electrical resistance (volume intrinsic resistance) is measured in the following manner.

Samples are mounted on the bottom electrode plate of a measurement jig which is a pair of 20 $cm^2$ circular (steel) electrode plates that are connected to an electrometer (manufactured by Keithley Instruments Inc., trade name: KEITHLEY 610C) and a high-pressure power supply (manufactured by Fluke Corporation, trade name: FLUKE 415B) so as to form an approximately 1 mm to 3 mm thick flat layer. Next, the upper electrode plate is placed on the samples, and then a 4 kg weight is placed on the upper electrode plate in order to remove voids between the samples. The thickness of the sample layer is measured in the current state. Next, an electric current value is measured by applying a voltage to both electrode plates, and a volume intrinsic resistance is calculated based on the following formula.

Volume intrinsic resistance=applied voltage×20÷(electric current value−initial electric current value)÷sample thickness In the above formula, the initial electric current refers to an electric current value when the applied voltage is zero, and the electric current value refers to a measured electric current value.

The mixing ratio of the toner and the carrier of the exemplary embodiment in the two-component electrostatic charge image developer is preferably from 2 parts by weight to 10 parts by weight of the toner with respect to 100 parts by weight of the carrier. In addition, the method of preparing the developer is not particularly limited, and examples thereof include a method in which a V blender is used for mixing, and the like.

Image Forming Method

In addition, the electrostatic charge image developer (electrostatic charge image developing toner) is used in an electrostatic charge image developing-type (electrophotography-type) image forming method.

The image forming method of the exemplary embodiment includes charging a surface of an image holding member, forming an electrostatic latent image on the surface of an image holding member, developing the electrostatic latent image formed on the surface of the image holding member using a developer including a toner so as to form a toner image, and transferring the toner image to the surface of a transfer medium, and may optionally include fixing the toner image transferred to the surface of the transfer medium, and cleaning the electrostatic charge image developer remaining on the image holding member, in which the electrostatic charge image developing toner of the exemplary embodiment or the electrostatic charge image developer of the exemplary embodiment is used as the developer.

The respective processes are ordinary processes, and described in, for example, JP-A-56-40868, JP-A-49-91231, and the like. Meanwhile, in the image forming method of the exemplary embodiment, a well-known image forming apparatus, such as a copying machine or a fax machine, may be used.

Forming an electrostatic latent image is a process in which an electrostatic latent image is formed on an image holding member (photoreceptor).

Developing the electrostatic latent image is a process in which the electrostatic latent image is developed using a developer layer on a developer holding member so as to form a toner image. The developer layer is not particularly limited as long as the developer layer includes the electrostatic charge image developing toner of the exemplary embodiment.

Transferring the toner image is a process in which the toner image is transferred to a transfer medium. In addition, examples of the transfer medium include a recording medium, such as an intermediate transfer article or paper.

While fixing the toner image, for example, the toner image transferred to transfer paper is fixed using a heating roller fixing machine for which the temperature of the heating roller is set to a certain temperature so as to form a copied image.

Cleaning the electrostatic charge image developer is a process in which the developer remaining on the image holding member is cleaned.

In addition, in the image forming method of the exemplary embodiment, cleaning the electrostatic charge image developer more preferably includes removing the electrostatic charge image developer remaining on the image holding member using a cleaning blade.

A well-known recording medium may be used as the recording medium, and examples thereof include paper, an OHP sheet, and the like that are used in an electrophotography-type copying machine, a printer, or the like. Preferable examples that may be used include coated paper obtained by coating the surface of plain paper with a resin or the like, printing art paper, and the like.

The image forming method of the exemplary embodiment may further include recycling. The recycling is a process in which the electrostatic charge image developing toner collected during the cleaning is moved to the developer layer. In the image forming method including the recycling, an image forming apparatus, such as a toner recycling system-type copying machine, fax machine, or the like, is used. In addition, the image forming method may be applied to a recycle system in which the toner is collected at the same time as developing.

Image Forming Apparatus

The image forming apparatus of the exemplary embodiment has an image holding member, a charging unit that charges the image holding member, a latent image forming unit that forms an electrostatic latent image on the surface of the image holding member, a developing unit that develops the electrostatic latent image using a developer including the toner so as to form a toner image, and a transfer unit that transfers the toner image from the image holding member to the surface of the transfer medium, and may further optionally include a fixing unit that fixes the toner image transferred to the surface of the transfer medium, and a cleaning unit that cleans the image holding member, in which the electrostatic charge image developing toner of the exemplary embodiment or the electrostatic charge image developer of the exemplary embodiment is used as the developer.

Meanwhile, the image forming apparatus of the exemplary embodiment is not particularly limited as long as the image forming apparatus includes at least the image holding member, the charging unit, the exposure unit, the developing unit, the transfer unit, the fixing unit, and the cleaning unit, but may also include an erasing unit and the like as necessary.

In the transfer unit, two or more times of transfer may be carried out using an intermediate transfer article. In addition, examples of the transfer medium in the transfer unit include recording medium, such as an intermediate transfer article and paper.

The image holding member and the respective units may preferably use the configuration that has been described in the respective processes of the above image forming method. Well-known units for the image forming apparatus may be used as the respective units. In addition, the image forming apparatus of the exemplary embodiment may include units, apparatuses, and the like other than the above configuration. In addition, in the image forming apparatus of the exemplary embodiment, plural units may be operated at the same time.

In addition, examples of the cleaning unit that cleans the electrostatic charge image developer remaining on the image holding member include a cleaning blade, a cleaning brush, and the like, and a cleaning blade is preferable.

A preferable material of the cleaning blade includes urethane rubber, neoprene rubber, silicone rubber, and the like.

Toner Cartridge, Developer Cartridge, and Process Cartridge

The toner cartridge of the exemplary embodiment is a toner cartridge accommodating at least the electrostatic charge image developing toner of the exemplary embodiment. That is, the toner cartridge of the exemplary embodiment may contain a toner containing chamber that accommodates the electrostatic charge image developing toner of the exemplary embodiment.

The developer cartridge of the exemplary embodiment is a developer cartridge accommodating at least the electrostatic charge image developer of the exemplary embodiment. That is, the developer cartridge of the exemplary embodiment may contain a developer containing chamber that accommodates the electrostatic charge image developer of the exemplary embodiment.

In addition, the process cartridge of the exemplary embodiment has at least one kind selected from a group consisting of a developing unit that develops the electrostatic latent image formed on the surface of the image holding member using the electrostatic charge image developing toner or the electrostatic charge image developer so as to form a toner image, the image holding member, the charging unit for charging the surface of the image holding member, and the cleaning unit for removing the toner remaining on the surface of the image holding member, and accommodates at least the electrostatic charge image developing toner of the exemplary embodiment or the electrostatic charge image developer of the exemplary embodiment.

The process cartridge of the exemplary embodiment may contain a developer holding member that holds and carries the electrostatic charge image developer of the exemplary embodiment.

The toner cartridge of the exemplary embodiment is preferably detachable from the image forming apparatus. That is, in an image forming apparatus having a configuration in which the toner cartridge is detachable, the toner cartridge of the exemplary embodiment which accommodates the toner of the exemplary embodiment is preferably used.

The developer cartridge of the exemplary embodiment is not particularly limited as long as the developer cartridge contains an electrostatic charge image developer including the electrostatic charge image developing toner of the exemplary embodiment. For example, the developer cartridge is attachable to and detachable from an image forming apparatus having a developing unit, and accommodates an electrostatic charge image developer including the electrostatic charge image developing toner of the exemplary embodiment as a developer for being supplied to the developing unit.

In addition, the developer cartridge may be a cartridge accommodating a toner and a carrier, or a cartridge separately having a cartridge singly accommodating a toner and a cartridge singly accommodating a carrier.

The process cartridge of the exemplary embodiment is preferably detachable from the image forming apparatus.

In addition, the process cartridge of the exemplary embodiment may include other members, such as an erasing unit, as necessary.

The toner cartridge and the process cartridge may employ a well-known configuration, and, for example, JP-A-2008-209489, JP-A-2008-233736, and the like may be referenced.

EXAMPLES

Hereinafter, the exemplary embodiment will be described in detail using different examples, but the examples do not limit the exemplary embodiment. Meanwhile, in the following description, "parts" refers to "parts by weight" unless otherwise described.

A Variety of Measurement Methods

Method of Measuring the Weight Average Molecular Weight and Molecular Weight Distribution of the Resin The molecular weight and molecular weight distribution of the binder resin or the like are measured under the following conditions. A "HLC-8120 GPC, SC8020 (manufactured by Tosoh Corporation) apparatus" is used as the GPC, two pieces of "TSKgel Super HM H (manufactured by Tosoh Corporation, 6.0 mmID×15 cm)" are used as the column, and tetrahydrofuran (THF) is used as an eluting solution. An experiment is carried out using an IR detecting machine under the experiment conditions of a sample concentration of 0.5%, a flow rate of 0.6 mL/min, a sample injection amount of 10 μL, and a measurement temperature of 40° C. In addition, the standard curve is manufactured using 10 samples of "polystyrene standard sample TSK standard" manufactured by Tosoh Corporation: "A 500," "F 1," "F 10," "F 80," "F 380," "A 2500," "F 4," "F 40," "F 128," and "F 700."

Volume Average Particle Diameters of Resin Particles, Colorant Particles, and the Like The volume average particle diameters of the resin particles, the colorant particles, and the like are measured using a laser diffraction particle size distribution measurement apparatus (manufactured by Horiba, Ltd., LA-700).

As the measurement method, a sample in a dispersion liquid state is prepared so as to weigh approximately 2 g in terms of solid content, and ion exchange water is added to the sample so as to form approximately 40 ml of a solution. The solution is injected to a cell so as to obtain an appropriate concentration, placed still for approximately 2 minutes, and the volume average particle diameter is measured when the concentration in the cell is stabilized. The volume average particle diameter for each of the obtained channels is accumulated from a smaller volume average particle diameter, and the volume average particle diameter at 50% cumulative values is used as the volume average particle diameter.

Method of Measuring the Melting Point and Glass Transition Temperature of the Resin The melting point of a crystalline polyester resin and the glass transition temperature (Tg) of an amorphous polyester resin are obtained from the measured maximum peak using a differential scanning calorimeter (manufactured by PerkinElmer Co., Ltd., DSC 7) based on ASTMD34188. The melting points of indium and zinc are used for temperature correction in the detecting portion of the apparatus (DSC 7), and the melting heat of indium is used for correction of the heat amount. An aluminum pan is used as a sample, an empty pan is set for reference, and measurement is carried out at a temperature increase rate of 10° C./min.

Method of Measuring the Volume Average Particle Diameter of the Toner Particles

The volume average particle diameter of the toner particles is measured using a COULTER MULTISIZER II (manufactured by Beckman Coulter, Inc.). ISOTON-II (manufactured by Beckman Coulter, Inc.) is used as an electrolytic solution.

In the measurement method, firstly, 0.5 mg to 50 mg of the measurement sample is added to a surfactant, preferably 2 ml of a 5% aqueous solution of sodium alkyl benzene sulfonate, as a dispersion agent, and the mixture is added to 100 ml to 150 ml of the electrolytic solution. The electrolytic solution having the measurement sample suspended is dispersed in an ultrasonic dispersing device for approximately one minute, and the particle size distribution of particles having a particle diameter in a range of 2.0 μm to 60 μm is measured using an aperture having an aperture radius of 100 μm in the COULTER MULTISIZER II. The number of particles measured is set to 50,000.

For the measured particle size distribution, the cumulative distribution is drawn from the smaller diameter side in terms of weight or volume in a divided particle size range (channel), and the 50% cumulative particle diameter is defined as the weight average particle diameter or the volume average particle diameter.

Preparation of the Respective Dispersion Liquid

Preparation of Crystalline Polyester Resin Particle Dispersion Liquid 1

After 260 parts by weight of 1,12-dodecane dicarboxylic acid, 165 parts by weight of 1,10-decanediol, and 0.035 parts by weight of tetra butoxy titanate are put into a heated and dried three-neck flask, the air in the container is depressurized through a depressurization operation, furthermore, an inert atmosphere is formed using nitrogen gas, and convection is carried out at 180° C. for 6 hours through mechanical stirring. After that, the temperature is slowly increased up to 220° C. through distillation under reduced pressure, the mixture is stirred for 2 to 3 hours, the distillation under reduced pressure is stopped when a viscous state is formed, and the mixture is cooled in the air, thereby obtaining a crystalline polyester resin 1.

The weight average molecule weight (Mw) of the obtained crystalline polyester resin 1 which is measured by the above method is 12,000. In addition, the melting point of the obtained crystalline polyester resin 1 is measured using the above measurement method using a differential scanning calorimeter (DSC), and is found to be 72° C.

Next, 180 parts by weight of the crystalline polyester resin 1 and 580 parts by weight of deionized water are put into a stainless beaker, and heated to 95° C. by placing the beaker in a warm bath. The mixture is stirred at 8,000 rpm using a homogenizer (manufactured by IKA Laboratory Technology, ULTRA-TURRAX T50) when the crystalline polyester resin 1 melts, and at the same time, ammonia water is added so as to adjust the pH to 7.0. Next, while 20 parts by weight of an aqueous solution having 0.8 parts by weight of an anionic surfactant (manufactured by Dai-ichi Kogyo Seiyaku Co., Ltd., NEOGEN R) diluted therein is added dropwise, emulsion dispersion is carried out, thereby preparing a crystalline polyester resin particle dispersion liquid 1 (resin particle concentration: 12.5% by weight) having a volume average particle diameter of 0.24 μm.

Preparation of Amorphous Polyester Resin Particle Dispersion Liquid 1

After 73 parts by weight of dimethyl adipate, 182 parts by weight of dimethyl terephthalate, 217 parts by weight of bisphenol A ethylene oxide adduct, 41 parts by weight of ethylene glycol, and 0.038 parts by weight of tetra butoxy titanate as a catalyst are put into a heated and dried two-neck flask, nitrogen gas is put into the container so as to maintain an inert atmosphere, the mixture is heated while being stirred, then, a condensation copolymerization reaction is caused at 160° C. for approximately 7 hours, then, the temperature is increased up to 220° C. while the pressure is decreased up to 10 Torr ($1.33\times10^{-3}$ MPa), and the atmosphere is held for 3.5 hours. Once the pressure is returned to an ordinary pressure, 9 parts by weight of trimelitic anhydride is added, the pressure is again slowly reduced up to 10 Torr ($1.33\times10^{-3}$ MPa), and the atmosphere is held for 1 hour, thereby synthesizing an amorphous polyester resin 1.

The glass transition temperature of the obtained amorphous polyester resin 1 is measured by the above measurement method using a differential scanning calorimeter (DSC), and is found to be 58° C. The molecular weight of the obtained amorphous polyester resin 1 is measured by the above measurement method using a GPC, and the weight average molecular weight (Mw) is 11,000.

Next, 115 parts by weight of the amorphous polyester resin 1, 180 parts by weight of deionized water, and 5 parts by weight of an anionic surfactant (manufactured by Dai-ichi Kogyo Seiyaku Co., Ltd., NEOGEN R) are mixed, heated at 120° C., then, sufficiently dispersed using a homogenizer (manufactured by IKA Laboratory Technology, ULTRA-TURRAX T50), and then a dispersion treatment is carried out for 1 hour using a pressure ejection-type gorlin homogenizer, thereby preparing an amorphous polyester resin particle dispersion liquid 1 (resin particle concentration: 40% by weight).

Preparation of Styrene Acryl Resin Dispersion Liquid 1

Oil Layer

Styrene (manufactured by Wako Pure Chemical Industries, Ltd.): 32 parts by weight n-butyl acrylate (manufactured by Wako Pure Chemical Industries, Ltd.): 8 parts by weight β-carboethyl acrylate (manufactured by Rhodia nikka): 1.2 parts by weight Dodecanethiol (manufactured by Wako Pure Chemical Industries, Ltd.): 0.5 parts by weight Aqueous Layer 1

Ion exchange water: 17.0 parts by weight

Anionic surfactant (sodium alkyl benzene sulfonate, manufactured by Rhodia Japan): 0.50 part by weight Aqueous Layer 2

Ion exchange water: 40 parts by weight

Anionic surfactant (sodium alkyl benzene sulfonate, manufactured by Rhodia Japan): 0.06 parts by weight Ammonium persulfate (manufactured by Wako Pure Chemical Industries, Ltd.): 0.4 parts by weight The oil layer components and the components of the aqueous layer 1 are put into a flask, stirred, and mixed so as to produce a monomer emulsion dispersion liquid. The components of the aqueous layer 2 are injected into a reaction container, the inside of the container is sufficiently substituted with nitrogen, and the mixture is heated in an oil bath under stirring so that the temperature of the reaction system reaches 75° C.

The monomer emulsion dispersion liquid is slowly added dropwise to the reaction container over 3 hours so as to carry out emulsion polymerization. After the dropwise addition, polymerization is continued at 75° C., and the polymerization is completed after 3 hours, thereby obtaining a styrene acryl resin dispersion liquid.

The volume average particle diameter of the resin particles in the obtained styrene acryl resin dispersion liquid is 330 nm, and the weight average molecular weight (Mw) is measured by the above method, and is found to be 12,500. In addition, the glass transition temperature is measured by the above measurement method using a differential scanning calorimeter (DSC), and is found to be 52° C.

Preparation of Colorant Dispersion Liquid

After 100 parts by weight of a cyan pigment (manufactured by Dainichiseika Color & Chemicals Mfg. Co., Ltd., Pigment Blue 15:3 (copper phthalocyanine), 15 parts by weight of an anionic surfactant (manufactured by Dai-ichi Kogyo Seiyaku Co., Ltd., NEOGEN R), and 300 parts by weight of ion exchange water are mixed, dispersed for 10 minutes using a homogenizer (manufactured by IKA Laboratory Technology, ULTRA-TURRAX T50), and then subjected to a circulation-type ultrasonic dispersion machine (manufactured by Nissei Corporation, RUS 600TCVP), thereby obtaining a colorant dispersion liquid.

The volume average particle diameter of the colorant (cyan pigment) in the obtained colorant dispersion liquid is measured by the above measurement method using a laser diffraction particle size measuring machine, and is found to be 0.17 μm. In addition, the solid content proportion of the cyan colorant dispersion liquid is 24% by weight.

Preparation of Release Agent Dispersion Liquid

After 95 parts by weight of Fischer-Tropsh wax FNP92 (melting point: 92° C., manufactured by Nippon Seiki Co., Ltd.), 3.6 parts by weight of an anionic surfactant (manufactured by Dai-ichi Kogyo Seiyaku Co., Ltd., NEOGEN R), and 360 parts by weight of ion exchange water are mixed, heated to 100° C., and sufficiently dispersed using a homogenizer (manufactured by IKA Laboratory Technology, ULTRA-TURRAX T50), a dispersion treatment is carried out using a pressure ejection-type gorlin homogenizer, thereby obtaining a release agent dispersion liquid.

The volume average particle diameter of the release agent in the obtained release agent dispersion liquid is measured by the above measurement method using a laser diffraction particle size measuring machine, and is found to be 0.24 μm. In addition, the solid content proportion of the release agent dispersion liquid is 20% by weight.

Manufacturing of Toner Particles 1

104.4 parts by weight of the crystalline polyester resin particle dispersion liquid 1, 336.1 parts by weight of the amorphous polyester resin particle dispersion liquid 1, 45.4 parts by weight of the colorant dispersion liquid, 115.3 parts by weight of the release agent dispersion liquid, and 484 parts by weight of deionized water are put into a round stainless steel flask, sufficiently mixed using an ULTRA-TURRAX T50, and dispersed. Next, 0.37 parts by weight of polyaluminum chloride is added to the mixture, and the mixture is continuously subjected to a dispersion operation in the ULTRA-TURRAX. Furthermore, the mixture is heated up to 52° C. while stirring the flask in a heating oil bath. After the mixture is held at 52° C. for 3 hours, 175 parts by weight of the amorphous polyester resin particle dispersion liquid 1 is smoothly added to the mixture. After that, the pH inside the system is adjusted to 8.5 using a 0.5 N sodium hydroxide aqueous solution, then the stainless steel flask is sealed, heated up to 90° C. while continuously stirred using a magnetic seal, and held for 3 hours. After completion of the reaction, the mixture is cooled, filtered, sufficiently washed using ion exchange water, and then solid and liquid are separated through Nutsche-type suction filtration. The mixture is again dispersed in 3 L of ion exchange water at 30° C., stirred at 300 rpm for 15 minutes, and washed. The above processes are repeated 5 times, washing is ended when the pH of the filtration liquid becomes 6.85, the electrical conductivity becomes 8.2 μS/cm, and the surface tension becomes 70.5 Nm, solid and liquid are separated through Nutsche-type suction filtration using No. 5A filtering paper, and then vacuum drying is carried out for 12 hours, thereby obtaining toner particles 1.

The volume average particle diameter of the obtained toner particles 1 is measured using the above measurement method, and is found to be 5.8

Manufacturing of Toner Particles 2

Styrene acryl resin dispersion liquid 1: 70 parts by weight

Colorant dispersion liquid: 14 parts by weight

Release agent dispersion liquid: 22 parts by weight

Polyaluminum chloride: 0.14 parts by weight

The above components are sufficiently mixed and dispersed in a round stainless steel flask using an ULTRA-TURRAX T50. Next, 0.32 parts by weight of polyaluminum chloride is added to the mixture, and a dispersion operation is continued using the ULTRA-TURRAX. The mixture is heated to 47° C. while the flask is stirred in a heating oil bath. After the mixture is held at 47° C. for 60 minutes, 30 parts by weight of the binder resin dispersion liquid is smoothly added to the mixture.

After that, the pH inside the system is adjusted to 6.0 using 0.5 mol/L of a sodium hydroxide aqueous solution, then, the stainless steel flask is sealed, the mixture is heated to 96° C. while stirring is continued using a magnetic seal, and held for 3.5 hours. After completion of the reaction, the mixture is cooled, filtered, sufficiently washed using ion exchange water, and then solid and liquid are separated through Nutsche-type suction filtration. Furthermore, the mixture is again dispersed in 3 L of ion exchange water at 40° C., stirred and washed at 300 rpm for 15 minutes.

The above processes are repeated 5 more times, and solid and liquid are separated through Nutsche-type suction filtration using No. 5A filtering paper when the pH of the filtration liquid becomes 7.01, the electrical conductivity becomes 9.7 μS/cm, and the surface tension becomes 71.2 Nm. Next, vacuum drying is continued for 12 hours, thereby manufacturing toner particles 2.

The volume average particle diameter of the obtained toner particles 2 is measured using the above measurement method, and is found to be 5.7 μm.

Manufacturing of Toner Particles 3

A mixture of 100 parts of a styrene-butyl acrylate copolymer (weight average molecular weight Mw=150,000, copolymerization ratio 80:20), 5 parts of carbon black (MOGUL L, manufactured by Cabot Corporation), and 6 parts of carnauba wax is kneaded using an extruder, pulverized using a jet mill, then, a spheroidizing treatment using warm air is carried out using a KRYPTRON (manufactured by Kawasaki Heavy Industries Ltd.), and the mixture is classified using a wind classifier, thereby obtaining toner particles 3. The volume average particle diameter of the obtained toner particles 3 is measured using the above method, and is found to be 6.2

External Additive

Using the following naphthalene-based oil, a treatment external additive is manufactured as follows.

SNH8 ($C_N$=57.5%, manufactured by Sankyo Yuka Kgyo K.K.)

SUNTHENE OIL 310 (SUNTHENE 310, $C_N$=43%, manufactured by Japan Sun Oil Company Ltd.)

HS TRANS N (JOMO HS TRANS N, $C_N$=39%, manufactured by JX Nippon Oil & Energy Corporation)

BARREL PROCESS OIL 8 ($C_N$=31%, manufactured by Matsumura Oil Co., Ltd.)

FUKKOL 1150N($C_N$=28%, manufactured by Fujikosan Co., Ltd.)

Dimethyl silicone oil (KF-96-50cs, manufactured by Shin-Etsu Chemical Co., Ltd.)

Preparation of Treatment External Additive 1

HMDS-treated hydrophobic fumed silica RX50 (average particle diameter 40 nm, manufactured by Nippon Aerosil Co., Ltd.) (10 parts by mass) is put into a sample mill, and 0.5 parts by weight of SNH-8 (manufactured by Sankyo Yuka Kogyo K.K.) is sprayed while stirring the HMDS-treated hydrophobic fumed silica RX50 at a temperature of 100° C., thereby obtaining a treatment external additive 1.

Preparation of Treatment External Additive 2

HMDS-treated hydrophobic fumed silica RX50 (average particle diameter 40 nm, manufactured by Nippon Aerosil Co., Ltd.) (10 parts by mass) is put into a sample mill, and 0.5 parts by weight of SUNTHENE OIL 310 (manufactured by Japan Sun Oil Company Ltd.) is sprayed while stirring the HMDS-treated hydrophobic fumed silica RX50 at a temperature of 100° C., thereby obtaining a treatment external additive 2.

Preparation of Treatment External Additive 3

HMDS-treated hydrophobic fumed silica RX50 (average particle diameter 40 nm, manufactured by Nippon Aerosil Co., Ltd.) (10 parts by mass) is put into a sample mill, and 0.5 parts by weight of HS TRANS N (manufactured by JX Nippon Oil & Energy Corporation) is sprayed while stirring the HMDS-treated hydrophobic fumed silica RX50 at a temperature of 100° C., thereby obtaining a treatment external additive 3.

Preparation of Treatment External Additive 4

HMDS-treated hydrophobic fumed silica RX50 (average particle diameter 40 nm, manufactured by Nippon Aerosil Co., Ltd.) (10 parts by mass) and 0.5 parts by weight of BARREL PROCESS OIL 8 (manufactured by Matsumura Oil Co., Ltd.) are mixed using a sample mill, thereby obtaining a treatment external additive 4.

Preparation of Treatment External Additive 5

HMDS-treated hydrophobic fumed silica RX50 (average particle diameter 40 nm, manufactured by Nippon Aerosil Co., Ltd.) (10 parts by mass) is put into a sample mill, and 0.5 parts by weight of FUKKOL 1150N (manufactured by Fujikosan Co., Ltd.) is sprayed while stirring the HMDS-treated hydrophobic fumed silica RX50 at a temperature of 100° C., thereby obtaining a treatment external additive 5.

Preparation of Treatment External Additive 6

Hydrophobic titanium oxide JMT-150AO (average particle diameter 15 nm, manufactured by Tayca Corporation) (10 parts by mass) is put into a sample mill, and 0.5 parts by weight of SNH-8 (manufactured by Sankyo Yuka Kogyo K.K.) is sprayed while stirring the hydrophobic titanium oxide JMT-150AO at a temperature of 100° C., thereby obtaining a treatment external additive 6.

Preparation of Treatment External Additive 7

HMDS-treated hydrophobic fumed silica RX50 (average particle diameter 40 nm, manufactured by Nippon Aerosil Co., Ltd.) (10 parts by mass) is put into a sample mill, and 0.5 parts by weight of Dimethyl silicone oil KF-96-50cs (manufactured by Shin-Etsu Chemical Co., Ltd.) is sprayed while stirring the HMDS-treated hydrophobic fumed silica RX50 at a temperature of 100° C., thereby obtaining a treatment external additive 7.

Example 1

Manufacturing of Externally Added Toner 1

The treatment external additive 1 (2.0 parts by weight) and hydrophobic titanium oxide JMT-2000 (manufactured by Tayca Corporation) (1.0 part by weight) are added to 100 parts by weight of the toner particles 1, and blended using a sample mill, thereby obtaining an externally added toner 1.

Preparation of Developer 1

The externally added toner 1 is weighed so that the toner concentration becomes 5% by weight with respect to a ferrite carrier which is coated with 1% by weight of polymethyl methacrylate (manufactured by Soken Chemical & Engineering Co., Ltd.) and has a volume average particle diameter of 50 μm, stirred, and mixed using a V blender for 30 minutes, thereby preparing a developer 1.

Example 2

A developer 2 is prepared in the same manner as in Example 1 except that the treatment external additive 2 is used in place of the treatment external additive 1.

Example 3

A developer 3 is prepared in the same manner as in Example 1 except that the treatment external additive 3 is used in place of the treatment external additive 1.

Example 4

A developer 4 is prepared in the same manner as in Example 1 except that the treatment external additive 4 is used in place of the treatment external additive 1.

Example 5

A developer 5 is prepared in the same manner as in Example 1 except that the treatment external additive 5 is used in place of the treatment external additive 1.

Example 6

A developer 6 is prepared in the same manner as in Example 1 except that the treatment external additive 6 is used in place of the treatment external additive 1.

Example 7

A developer 7 is prepared in the same manner as in Example 1 except that the toner particles 2 are used in place of the toner particles 1.

Example 8

A developer 8 is prepared in the same manner as in Example 1 except that the toner particles 3 are used in place of the toner particles 1.

Comparative Example 1

A developer 9 is prepared in the same manner as in Example 1 except that the treatment external additive 7 is used in place of the treatment external additive 1.

Comparative Example 2

A developer 10 is prepared in the same manner as in Example 1 except that the HMDS-treated hydrophobic fumed silica RX50 is used in place of the treatment external additive 1.

Using the respective developers obtained above, the following evaluation is carried out. The results are shown in Table 1.

Evaluation of Cleaning Properties

A test of outputting 30,000 sheets of images using a reforming machine (from which a fixing machine is removed) DocuCenterColor 400 (manufactured by Fuji Xerox Co., Ltd.), A4-sized plain paper (manufactured by Fuji Xerox Co., Ltd., C2 paper), and 5% of the Imaging Society of Japan's test chart No. 8 under a low-humidity environment of 15% and 20° C. is carried out. For every 10,000 sheets, the photoreceptor is removed, and the photoreceptor surface and the outputted image surface are visually observed. The evaluation standards are as follows, and A to C is set to an acceptable range. Meanwhile, the test is stopped for samples evaluated to be D at that stage. At a point in time when 20,000 sheets are completed, samples evaluated to be better than C are considered to be excellent in terms of cleaning properties as the toner according to the exemplary embodiment. Meanwhile, in the evaluation of the cleaning properties, suppression of image defects caused by poor cleaning (filming), that is, image quality stability is evaluated.

A: Neither attachment of foreign substances on the photoreceptor nor toner contamination on the image is observed visually.

B: Attachment of foreign substances is observed on the photoreceptor, but is not observed on the image.

C: Attachment of foreign substances is observed on the photoreceptor, and slight toner contamination is observed on the image.

D: Toner contamination is observed on the entire surface of the photoreceptor.

Evaluation of Image Quality Stability

A test of outputting 30,000 sheets of images over 2 days using a reforming machine DocuCenterColor 400 (manufactured by Fuji Xerox Co., Ltd.), A4-sized plain paper (manufactured by Fuji Xerox Co., Ltd., C2 paper), and 5% of the Imaging Society of Japan's test chart No. 8 under a high-temperature and high-humidity environment of 30° C. and 88% is carried out. 20,000 sheets are continuously outputted on the first day, the Imaging Society of Japan's test chart No. 1 is outputted the next day (on the second day), and then, furthermore, 10,000 sheets is continuously outputted for 1 day. The next day (on the third day) at which a total of 30,000 sheets are outputted, the Imaging Society of Japan's test chart No. 1 is outputted, and image quality is evaluated.

A: No fogging is observed on the image, there is no problem with image quality, and no contamination in the actual machine is observed.

B: No fogging is observed on the image, but contamination in the actual machine is slightly observed.

C: Fogging is slightly observed on the image, and contamination in the actual machine is observed.

D: Fogging and deterioration of the reproducibility of fine lines are observed on the image, and contamination in the actual machine is observed.

TABLE 1

| | Toner particles | Inorganic particles | Treatment agent | % $C_N$ | Cleaning properties evaluation | Image quality stability evaluation |
|---|---|---|---|---|---|---|
| Example 1 | 1 | Silica | SNH-8 | 58 | A | A |
| Example 2 | 1 | Silica | SUNTHENE OIL 310 | 43 | A | A |
| Example 3 | 1 | Silica | HS TRANS N | 39 | A | B |
| Example 4 | 1 | Silica | BARREL PROCESS OIL 8 | 31 | A | B |
| Example 5 | 1 | Silica | FUKKOL 1150N | 28 | A | C |
| Example 6 | 1 | Titanium oxide | SNH-8 | 58 | A | A |
| Example 7 | 2 | Silica | SNH-8 | 58 | A | A |
| Example 8 | 3 | Silica | SNH-8 | 58 | A | A |
| Comparative example 1 | 1 | Silica | Dimethyl silicone oil | — | A | D |
| Comparative example 2 | 1 | Silica | None | — | D | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An electrostatic charge image developing toner comprising:

toner particles containing a colorant, a binder resin and a release agent; and an external additive, wherein the external additive contains inorganic particles having a hydrocarbon oil that contains a naphthene-based hydrocarbon on the surfaces thereof.

2. The electrostatic charge image developing toner according to claim 1, wherein a content of the naphthene-based hydrocarbon in the hydrocarbon oil is 30% or more.

3. The electrostatic charge image developing toner according to claim 1, wherein a content of the hydrocarbon oil is in a range of 0.16% by weight to 5.5% by weight with respect to the total weight of the electrostatic charge image developing toner.

4. The electrostatic charge image developing toner according to claim 1, wherein 80% or more of the area of the surfaces of the inorganic particles are coated with the hydrocarbon oil.

5. The electrostatic charge image developing toner according to claim 1, wherein the naphthene-based hydrocarbon is selected from the group consisting of cyclopentane, methylcyclopentane, 1,1-dimethylcyclopentane, 1,3-dimethylcyclopentane, cyclohexane, methylcyclohexane, ethylcyclohexane, and 1,2,4-trimethylcyclohexane.

6. The electrostatic charge image developing toner according to claim 1, wherein a content of the naphthene-based hydrocarbon in the hydrocarbon oil is 40% or more.

7. The electrostatic charge image developing toner according to claim 1, wherein a volume average primary particle diameter of the inorganic particles is in a range of 5 nm to 100 nm.

8. The electrostatic charge image developing toner according to claim 1, wherein a content of the inorganic particles having the hydrocarbon oil on the surfaces thereof is in a range of 0.3% by weight to 10% by weight with respect to the total weight of the toner.

9. The electrostatic charge image developing toner according to claim 1, wherein the toner particles contain a crystalline polyester resin in a range of 2% by weight to 30% by weight with respect to the total weight of the toner particles.

10. An electrostatic charge image developer comprising:

the toner according to claim 1; and a carrier.

11. The electrostatic charge image developer according to claim 10, wherein a content of the naphthene-based hydrocarbon in the hydrocarbon oil is 30% or more.

12. An image forming method comprising:

charging a surface of an image holding member;

forming an electrostatic latent image on the surface of the image holding member;

developing the electrostatic latent image formed on the surface of the image holding member using a developer so as to form a toner image; and transferring the formed toner image to a transfer medium, wherein the developer is the electrostatic charge image developer according to claim 10.

13. The image forming method according to claim 12, wherein a content of the naphthene-based hydrocarbon in the hydrocarbon oil is 30% or more.

* * * * *